US009373235B2

(12) United States Patent
Jiang et al.

(10) Patent No.: US 9,373,235 B2
(45) Date of Patent: Jun. 21, 2016

(54) SYSTEM AND METHOD FOR STORING AND MONITORING EVENTS AT SECURITY DEVICES

(71) Applicant: Honeywell International Inc., Morristown, NJ (US)

(72) Inventors: ZhongYa Jiang, Guangdong (CN); TianFeng Zhao, Guangdong (CN); Richard Alan Smith, Bend, OR (US); Kevin G. Piel, Ronkonkoma, NY (US); Kenneth L. Addy, Massapequa, NY (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 180 days.

(21) Appl. No.: 13/864,713

(22) Filed: Apr. 17, 2013

(65) Prior Publication Data

US 2014/0313028 A1 Oct. 23, 2014

(51) Int. Cl.

| | |
|---|---|
| ***G08B 29/00*** | (2006.01) |
| ***G08B 13/16*** | (2006.01) |
| ***G08B 13/04*** | (2006.01) |

(52) U.S. Cl.

CPC ..... *G08B 13/1672* (2013.01); *G08B 13/04* (2013.01)

(58) Field of Classification Search

CPC ..... G08B 29/185

USPC ..... 340/506, 541, 545.1, 550, 565, 566; 381/56

See application file for complete search history.

(56) References Cited

U.S. PATENT DOCUMENTS

| | | | | |
|---|---|---|---|---|
| 6,236,313 | B1 * | 5/2001 | Eskildsen et al. | 340/550 |
| 6,538,570 | B1 * | 3/2003 | Smith | 340/550 |
| 7,319,392 | B2 * | 1/2008 | Babich et al. | 340/545.2 |
| 7,680,283 | B2 * | 3/2010 | Eskildsen | 381/56 |
| 2003/0110393 | A1 * | 6/2003 | Brock et al. | 713/200 |
| 2005/0207487 | A1 * | 9/2005 | Monroe | 375/240.01 |
| 2008/0252475 | A1 | 10/2008 | Jensen et al. | |

OTHER PUBLICATIONS

Official Action and Examination Search Report from corresponding Canadian patent application 2,848,554, dated Dec. 2, 2015.

* cited by examiner

*Primary Examiner* — Toan N Pham

(74) *Attorney, Agent, or Firm* — Husch Blackwell LLP

(57) ABSTRACT

An alarm or intrusion monitoring system includes a plurality of detectors which communicate with a displaced control element. Various of the detectors include local storage circuitry wherein detected conditions or events are recorded along with a time indicator. Recorded events and respective times of occurrence can be downloaded to the control element for evaluation. Detected conditions or events can include system conditions, such as faults or detector off-line indicators, as well as various intrusion or environmental-type incidents such as smoke, gas, temperature or fire.

14 Claims, 3 Drawing Sheets

SYSTEM AND METHOD FOR STORING AND MONITORING EVENTS AT SECURITY DEVICES

FIELD

The application pertains to systems and methods for storing and monitoring events at security devices. More particularly, the application pertains to such systems and methods which store event related information along with a time stamp.

BACKGROUND

Known security system intrusion detection devices, such as glass break detectors, and motion sensors, communicate alarm results (e.g. glass breakage events, and human movement), and other statuses (trouble status with tamper or self-test), to a common control panel via wireless or wired communications.

Although intrusion detectors are widely sold and installed, they can still experience false alarms as well as non-detects at times. In practice, it is difficult for authorities or installers to determine if a device alarmed to a false alarm event (false positive) or judged an alarm event as a false alarm (false negative) when it should have resulted in an actual alarm. In other words, it is difficult for authorities or installers to determine if a false alarm or missed alarm event is resulted from a detector itself or other status changes (e.g. wires broken for wired communication; jam of wireless or wired communication; communication error; panel error and etc.) of communication between a detector and control panel. These issues can result in a significant inconvenience, possibly causing confusion, and have an effect on the authorities', and/or customers', confidence in the devices' performance.

In summary, known security system devices have not included event and result storage, or monitoring, and therefore cannot completely meet the requirements of user confirmation and post analysis of results to determine if an event was a missed alarm or false alarm.

DETAILED DESCRIPTION

Figure 1:
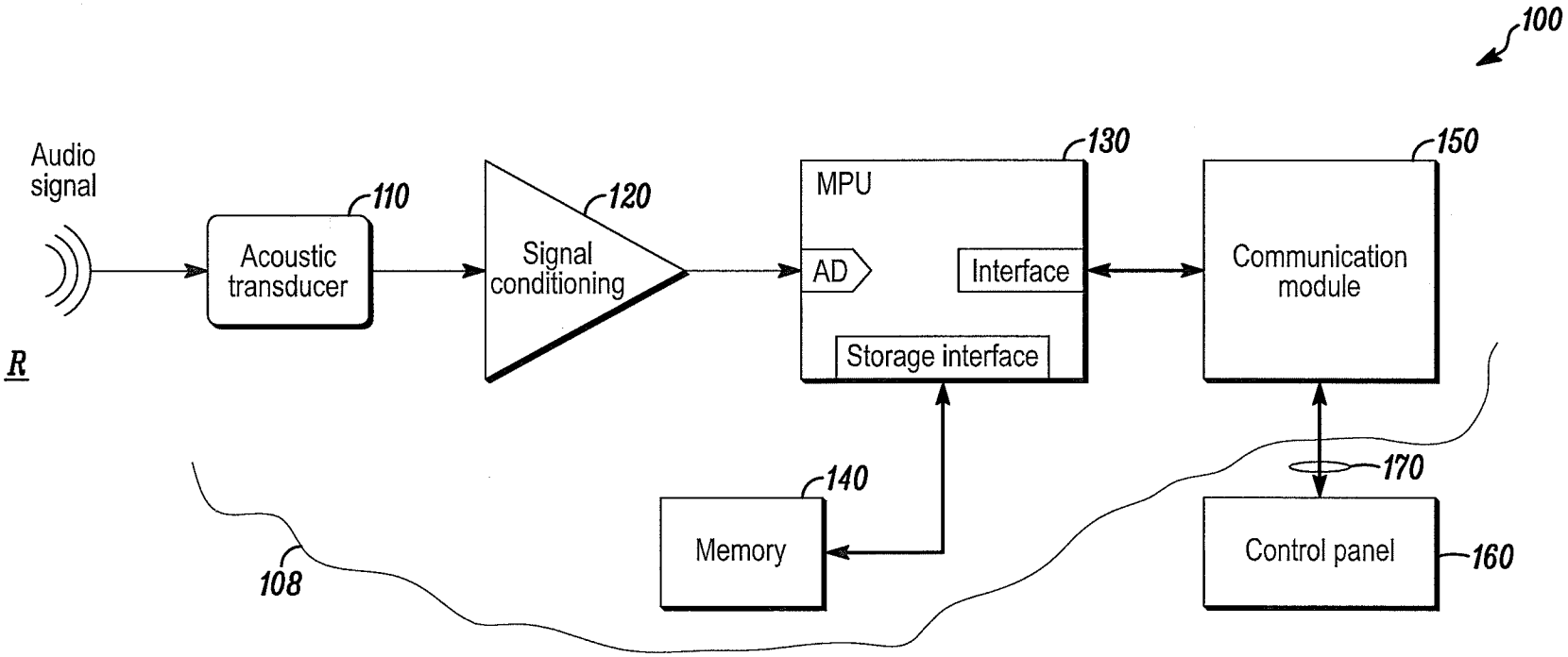
FIG. 1 illustrates a block diagram of a detector in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

To solve the problems mentioned above embodiments store monitored events for future retrieval and analysis. A method and system with event storage can improve the reliability of security system devices. The stored data can be retrieved at any time by authorities, or retrieved and sent to the device manufacturer for further analysis. The stored data may be retrieved, via wired or wireless communication methods or directly by a retrieval device, from the respective detector.

Considering the memory limits of security devices, another embodiment is also provided here which allows the glass break detector or other security device to only record the event based on the system status, armed or disarmed. By doing so, it is easier to determine actual events from false alarms, thereby making post analysis easier to perform. Furthermore, in order to avoid reaching memory limits, or, filling the allocated memory of a security device, memory space filled with events detected more than a predetermined number of days past which have already been retrieved, or would not be used further for post analysis could be released and reused to store current event information.

FIG. 1 illustrates an exemplary glass-break detector 100 in accordance herewith. It will be understood that while a glass-break detector is disclosed herein, other types of security system devices come within the spirit and scope hereof. In FIG. 1, elements of detector 100 are carried in a housing 108. These include an acoustic transducer module 110, an analog signal conditioning module 120, control circuits 130 which could be implemented at least in part by one of a programmable microprocessor (MPU), or a digital signal processor (DSP). A storage or, memory module 140 is coupled to circuits 130 along with a communication module 150. The direction of arrows represents the signal flow or the control signal flow.

When there is a glass break incident in monitored region R, the acoustic transducer module 110 senses the sound characteristics and outputs a signal that will be conditioned by the analog signal conditioning module 120. The conditioned signal will then be sampled, further processed, and the results determined by the control circuit module 130. If the module 130 determines that an event had characteristics of glass breakage, and met alarm criteria, then the event would be stored in the memory module 140. Finally, the communication module 150 sends the results to a remote, common, control panel 160 via a wired or wireless medium 170.

While only the glass break event operational process has been described, the types of events can be expanded to include tamper, environmental, or trouble events. In summary, events can be monitored and the results stored to meet the authorities'/customers' needs for data to carry out post analysis.

Those of skill will understand that a variety of events, or, sensors come within the spirit and scope hereof. These include, without limitation, fault generated events, intrusion events from sensors of all types including motion, infrared, vibration, and glass break sensors, as well as environmental events, from sensors such as smoke, flame, gas, humidity, and temperature sensors.

Figure 2:
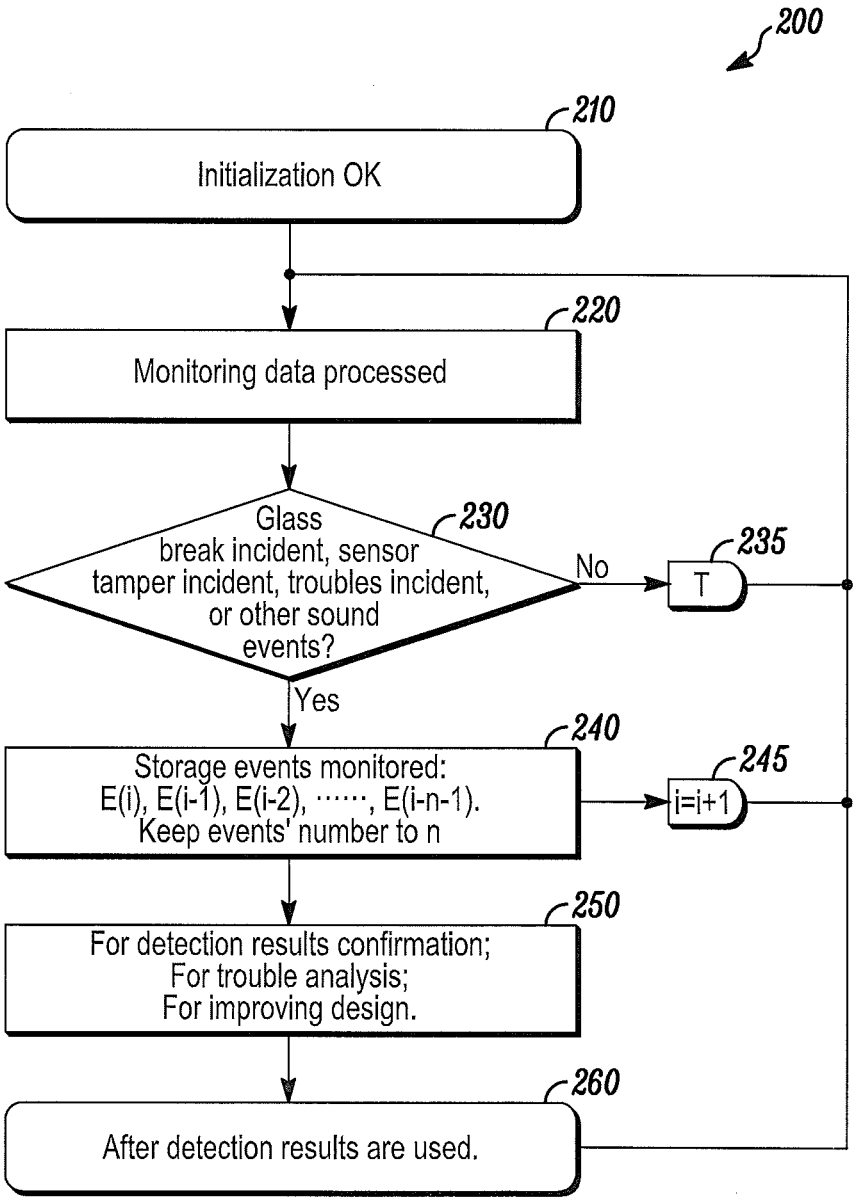
FIG. 2 is a flow diagram illustrating aspects of operation of the detector of FIG. 1.

A flow diagram 200 of a method of operating a plurality glass break detectors is illustrated in FIG. 2. The respective detectors are initialized, as at 210. Monitoring of a respective region is undertaken as at 220. In the presence of detected sound events, as at 230, the current event is stored, as at 240, and a pointer updated, as at 245.

Stored data can include incident information as well as a time stamp. Subsequently, detection results can be confirmed and used for analysis as at 250, 260.

Figure 3:
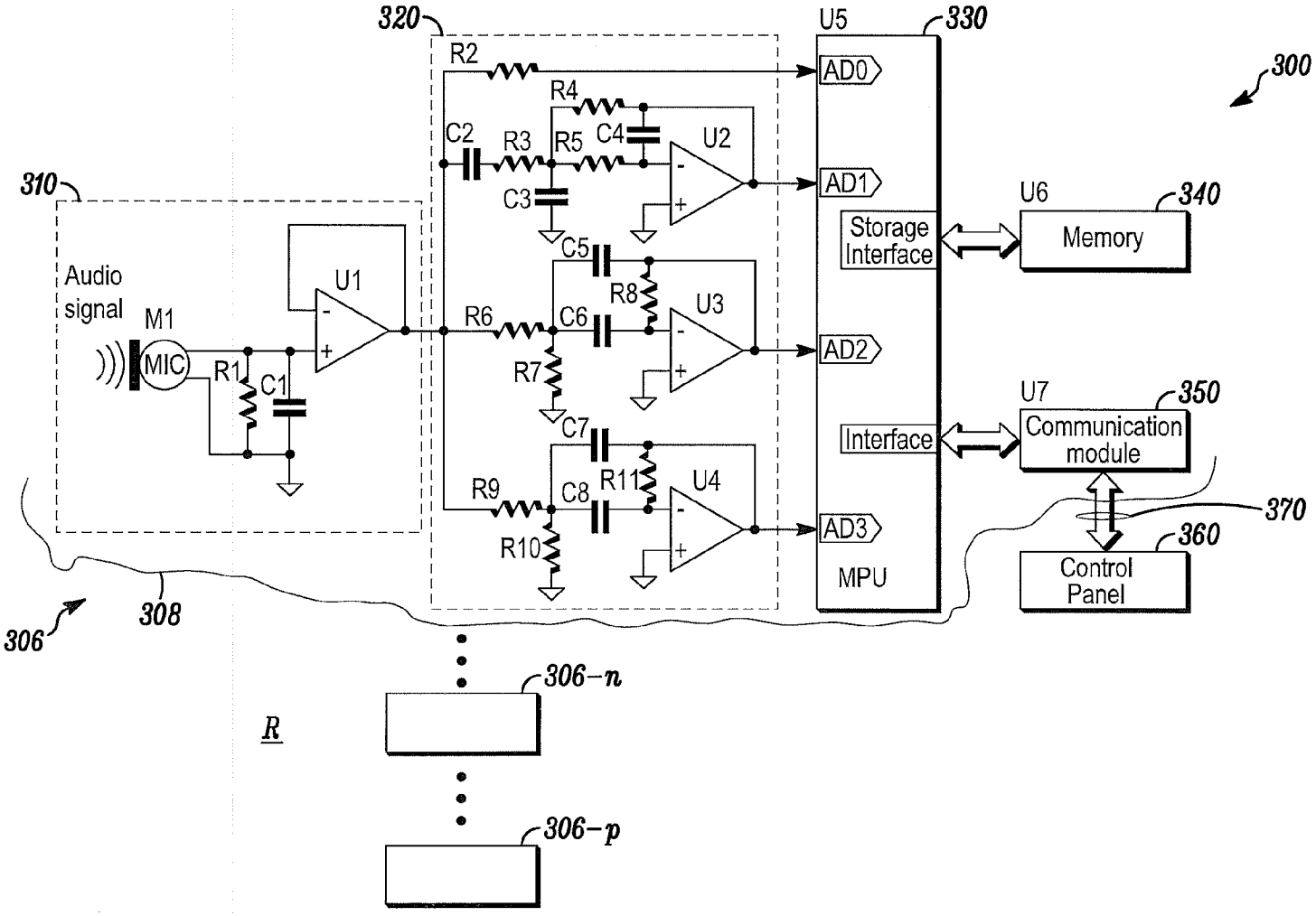
FIG. 3 illustrates additional aspects of the detector of FIG. 1.

FIG. 3 illustrates additional details of a system 300 in accordance herewith. In FIG. 3, a glass break detector 306 in accordance herewith is disclosed in detail. The system 300 can include a plurality of detectors, 306-*n* . . . 306-*p*. The members of the plurality may incorporate different types of event sensors but will process and store event information substantially identical to the processing of detector 306. Hence only the detector 306 needs to be discussed.

Detector 306 includes a housing 308 which carries an acoustic transducer module 310, an analog signal conditioning module 320, a programmable processor module 330, implementable with a micro-processor unit (MPU) or alternates such as a digital signal processor (DSP) A storage, or, memory module 340, is coupled to the circuitry 330 as is a communication module 350. The detectors 306 . . . 306-*p* can communicate with a control panel 360 via a wired or wireless medium 370.

Again, with respect to detector 306, when the sensor 310 senses the sound signal it outputs a signal to the analog signal processing module 320. Then the processed signal is sampled, further processed and the results determined by the processor module 330. If the MPU 330 determines that an event is identified as glass breakage (trouble incidents, tamper incidents or other reportable events), then the event is stored with at least timestamp information in the memory module 340. The stored events could be encoded and compressed in order to save memory. Finally, the communication module 350 sends the results to the displaced system control panel 360.

In yet another aspect, when a security system is in an armed state, if an event occurs and the detector goes into alarm or fault, the event can be recorded. Upon inspection by the authorities, if the event appears to be a false alarm, further analysis of the recording can be performed to determine that the event may have been an attempt to break in, but ended in failure.

Likewise, to determine what types of everyday occurrences may cause a false alarm, the detector may be programmed to record events during the disarmed state. These events can be time stamped in the detector by its own real time clock or via two way communication with the control panel 360 that includes a real time clock. When an event occurs, the detector 306, or any other member of the plurality can receive a time stamp back from the control panel 360 to link to the event. If the detector has its own real time clock, it would calibrate its clock periodically from the devices to which it reports such as the control panel, central monitoring station, cloud calculation center, etc.

In summary, event storage and monitoring for security system devices have been disclosed. Methods and systems for the monitoring and storage of security system device events have been provided. Those of skill in the art will understand that the present embodiments are applicable to different types of environmental, or event detectors including smoke or gas detectors as well as intrusion detectors, without limitation, and can be incorporated into any security system.

In one aspect, the current embodiments can effectively identify incidents by using the design concept of event storage and recall, to meet the authorities', and/or, the customers' needs. Event information can be provided by the disclosed processing and monitoring workflow. In another aspect, the processing method of detecting, storing, and recalling events, as described above, is simple and effective, and will be helpful for failure analysis and confirming results. By recording events based on the state of the security panel, it is easier to determine actual events from false alarms, thereby making post analysis easier to perform.

The events captured locally at the respective detector(s) can be stored not only at detector(s) but also at a control panel such as panel 360. They also can be stored at central monitoring station.

The detector can synchronize its clock to the control panel periodically in order to provide a precise time stamp to the events it detects and stores. A local clock is useful when the detector can't communicate with a control panel and when events are detected and event information needs to be stored on the detector side. For example, when the detector(s) can't send the alarm to the panel because the communication link has failed, a record is stored and available at the respective detector to forward for post-mortem analysis when the link is restored.

In one aspect, events can be captured locally at the respective detector and forwarded to a control panel. When the event has been received by the control panel, the panel will associate a time stamp with that event. The control panel can include a clock, to provide a time stamp.

Further, the event can be forwarded electronically to a central monitoring station, or other authorized personnel, to permit review and/or determination that there was an actual event such as a glass break.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A detector comprising:

an event sensor;

local control circuits coupled to the sensor;

storage circuits coupled to the control circuits; and a wired or wireless communications interface coupled to the control circuits, wherein the control circuits store, in the storage circuits, information pertaining to a plurality detected events and respective time stamp information for each of the plurality of detected events, and wherein the control circuits periodically receive, via the communications interface, time related information from a displaced monitoring control unit.

2. A detector as in claim 1 which includes a clock coupled to the control circuits to provide the respective time stamp information.

3. A detector as in claim 1 which includes a clock coupled to the control circuits to provide the respective time stamp information, wherein the detected events include sensed environmental or non-environmental incidents.

4. A detector as in claim 1 wherein the stored information is retained for a pre-determined time interval.

5. A detector as in claim 1 wherein the control circuits transmit, via the communications interface, the stored information to the displaced monitoring control unit.

6. A detector as in claim 1 where the sensor is selected from a class which includes at least, intrusion sensors, position sensors, and environmental condition sensors.

7. A detector as in claim 1 wherein the control circuits delete the stored information in response to a predetermined criterion.

8. A regional monitoring system comprising:

a plurality of event detectors; and a common control element that communicates with each of the detectors via a selected medium, wherein at least some of the detectors include an incident sensor, local control circuits coupled to the sensor and storage circuits coupled to the control circuits, wherein the control circuits store, in the storage circuits, information pertaining to a plurality of detected incidents and respective time stamp information for each of the plurality of detected incidents, wherein at least some of the detectors communicate at least some of the stored information to the control element for evaluation, and wherein at least some of the detectors periodically receive time related information from the control element.

9. A regional monitoring system as in claim 8 wherein at least some of the event detectors include a real-time clock and circuitry to synchronize the respective clocks with the common control element according to the time related information received from the control element.

10. A regional monitoring system as in claim 8 wherein the control element exhibits an armed, and a disarmed status, and, wherein the information pertaining to the plurality of detected incidents is stored in respective detectors only when the control element has a predetermined status.

11. A regional monitoring system as in claim 8 wherein incident sensors are selected from a class which includes at least glass breakage sensors, motion sensors, intrusion sensors, infrared sensors, vibration sensors, smoke sensors, flame sensors, gas sensors, humidity sensors and temperature sensors.

12. A regional monitoring system as in claim 8 wherein selected ones of the detectors delete the stored information in response to a predetermined criterion.

13. A monitoring system comprising:

a plurality of detectors which communicate with a separate monitoring control panel, wherein various of the detectors include local storage circuitry for storing information pertaining to a plurality of detected conditions or events and respective time stamp information for each of the plurality of detected conditions or events, wherein at least some of the detectors download the stored information to the control panel for evaluation, wherein the plurality of detected conditions or events includes at least one of, system conditions, faults, detector off-line indicators, intrusion, and environmental-type events, including smoke, gas, temperature or fire, and wherein at least some of the detectors periodically receive time related information from the control panel.

14. A monitoring system as claim 13 wherein selected ones of the detectors delete the stored information in response to a predetermined criterion.

* * * * *